United States Patent [19]

Nishikawa

[11] Patent Number: 4,574,510

[45] Date of Patent: Mar. 11, 1986

[54] BARREL LOCKING MECHANISM FOR BREAK-OPEN-ACTION GUN

[75] Inventor: Tadahiro Nishikawa, Nangoku, Japan

[73] Assignee: Kabushiki Kaisha Miroku Seisakusho, Kochi, Japan

[21] Appl. No.: 594,115

[22] Filed: Mar. 28, 1984

[30] Foreign Application Priority Data

Mar. 30, 1983 [JP] Japan ..... 58-52512

[51] Int. Cl.[4] ..... F41C 11/08

[52] U.S. Cl. ..... 42/40; 42/44

[58] Field of Search ..... 42/40, 44; 16/319, 337, 16/341

[56] References Cited

U.S. PATENT DOCUMENTS 928,608 7/1909 Jaeger ..... 42/40

FOREIGN PATENT DOCUMENTS 2841938 4/1980 Fed. Rep. of Germany ..... 42/40

*Primary Examiner*—Charles T. Jordan
*Assistant Examiner*—Ted L. Parr
*Attorney, Agent, or Firm*—Shlesinger, Arkwright, Garvey & Fado

[57] ABSTRACT

A barrel locking mechanism for a break-open-action gun having a barrel and a mechanical section rotatably engaged with each other by a hinge-pin. It has a lug secured to the barrel and having a delining surface. While a stationary receiver is integrally mounted on the mechanical section. On the top of it, a movable receiver having a delining surface corresponding to that of the lug is vertically movably mounted through a spring. When the gun is locked, the lug moves downwards depressing the movable receiver against the spring. As a result, intimate contact of the corresponding surfaces is obtained in order to receive the load when the gun is discharged.

17 Claims, 6 Drawing Figures

BARREL LOCKING MECHANISM FOR BREAK-OPEN-ACTION GUN

BACKGROUND OF THE INVENTION

This invention relates to a barrel locking mechanism for a break-open-action gun.

In a conventional double barreled break-open-action gun, as shown in FIGS. 1 and 2, a barrel section A is in general so constructed as to be separable from a mechanical section B. Said mechanical section B is provided with a hinge-pin b, on which a bearing a contained in the barrel A is rotatably connected so that the barrel section A is break-openable when loading or unloading, or the like.

Now, when the gun is loaded with bullets and discharged, the bullets are propelled towards the muzzle by means of the burning of explosive powder. As a reaction of this discharge, tremendous force is exerted on breech face c, tending to separate the barrel section A from the mechanical section B. This force is received by said hinge-pin b.

Therefore, at first every maker tried to employ a relatively large diameter hinge-pin and then, in order to disperse the load concentrated on the hinge-pin at the time when the gun is discharged, a lug d was provided at the barrel section A so that it contacted receiver e provided at the mechanical section B when the gun is locked.

However, in order to have the lug precisely contact the receiver e when the barrel is shut or locked, extremely high accuracy of workmanship is required for making the related parts. At present, skilled workers labor to file such parts, spending much time during manufacture. Particularly, a gun which is designed for stability is provided with a hinge-pin at a relatively upper position of the barrel. In such a case, since the pin is provided at the mechanical section in such a manner as to be dividedly positioned on both outer sides of the bore of the barrel, heavy loads cannot be exerted on said divided-pin and permit it to serve solely as a rotary axis when the gun is opened or shut. In this case, filing work is especially important and durability of the gun depends largely on how well the work is done.

The present invention is accomplished in order to overcome the above mentioned disadvantages.

SUMMARY OF THE INVENTION

It is therefore an object of the present invention to provide a barrel locking mechanism which can effectively secure the barrel when the gun is discharged without jeopardizing stability.

It is another object of the invention to provide a barrel locking mechanism which is easy to manufacture.

It is a further object of the invention to provide a barrel locking mechanism wherein the barrel is interchangeable.

To achieve the above mentioned objects, there is essentially provided a barrel locking mechanism for a break-open-action gun including a barrel section containing a bearing at a rear portion thereof which is rotatably engaged with a forward portion of a mechanical section by means of a hinge-pin comprising a lug secured to the barrel section and having a declining contact-surface facing generally downwards. A movable receiver has a declining surface facing generally upwards and corresponding to the contact surface of the lug. A stationary receiver is integrally mounted on the interior of the mechanical section. The movable receiver is vertically movably mounted on the stationary receiver by means of a spring energizing the movable receiver upwards. In this way, when the barrel is locked, said lug is urged to move downwards and thus depresses the movable receiver against the biasing force of the spring in order to cause intimate contact between the corresponding surfaces of the receivers.

DETAILED DESCRIPTION OF THE EMBODIMENTS

Figure 1:
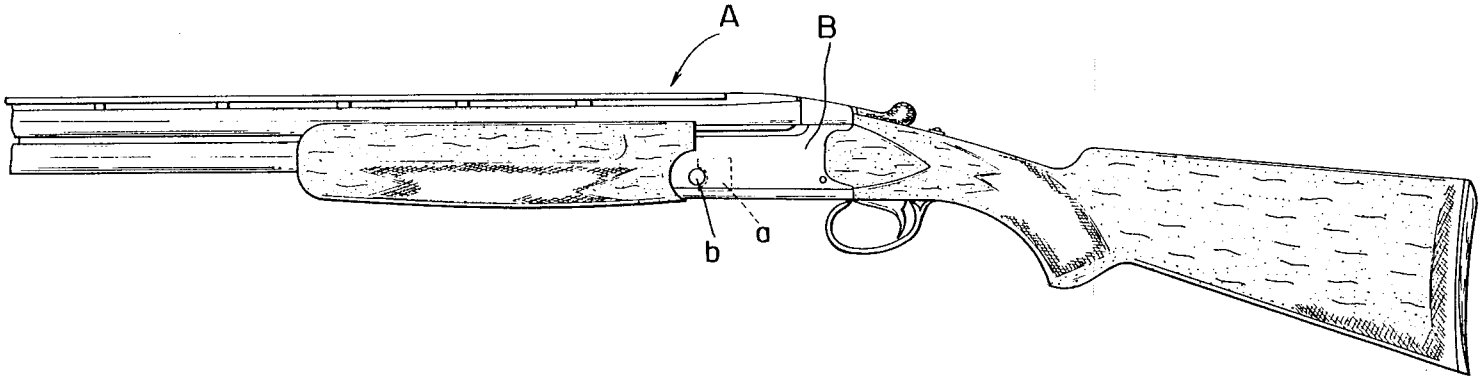
FIG. 1 is a side view of a break-open-action gun in its locked state.
Figure 2:
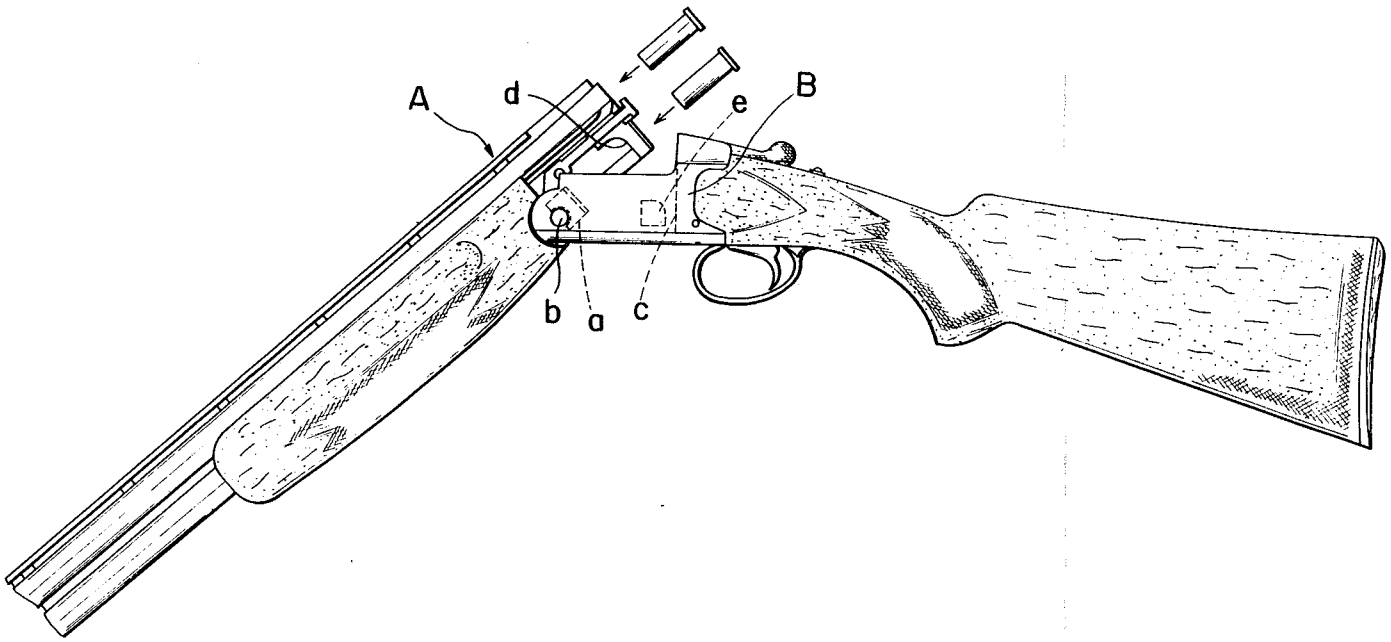
FIG. 2 shows the opened state of the above.

A preferred embodiment of the present invention will be hereinafter described with reference to FIG. 3. In the drawing, A is a barrel and B denotes a mechanical section. Said mechanical section B is provided with a hinge-pin 1, while said barrel A is provided with a bearing 2. Said barrel A is further provided with a lug 3 in order to prevent the barrel from moving axially when the gun is discharged. Also provided at the mechanical section B is a movable receiver 4 corresponding to said lug 3.

The movable receiver 4 is generally an inverted U shape. The inverted U-shaped movable receiver has an intermediate side 4*a* at the top and two sides, 4*b* and 4*c*, facing each other thereunder. Receiver 4 is vertically movably mounted on stationary receiver 5 which is integrally mounted on the inner surface of the mechanical section B. The movable receiver 4 is always urged upwardly at the side 4*a* by means of a coil spring 6 disposed between said movable receiver 4 and said stationary receiver 5. The upward movement of the movable receiver 4 is stopped by a stop-pin 7 positioned proximate the lower portion of side 4*c* and which engages shoulder portion 5*a* of the stationary receiver 5.

The outside of side 4*b* of the movable receiver 4 has a declining contact-surface 4*d* corresponding to generally the shape of lug 3 of the barrel. This declining contact-surface 4*d* subtends an angle of $\alpha$ which widens upwardly with respect to breech face 8. This angle $\alpha$ must be smaller than the friction angle between the two steel members and most preferably is around 10°. The lug 3 of the barrel is provided with a declining contact-surface 3*a* corresponding to said declining contact-surface 4*d*.

Figure 3:
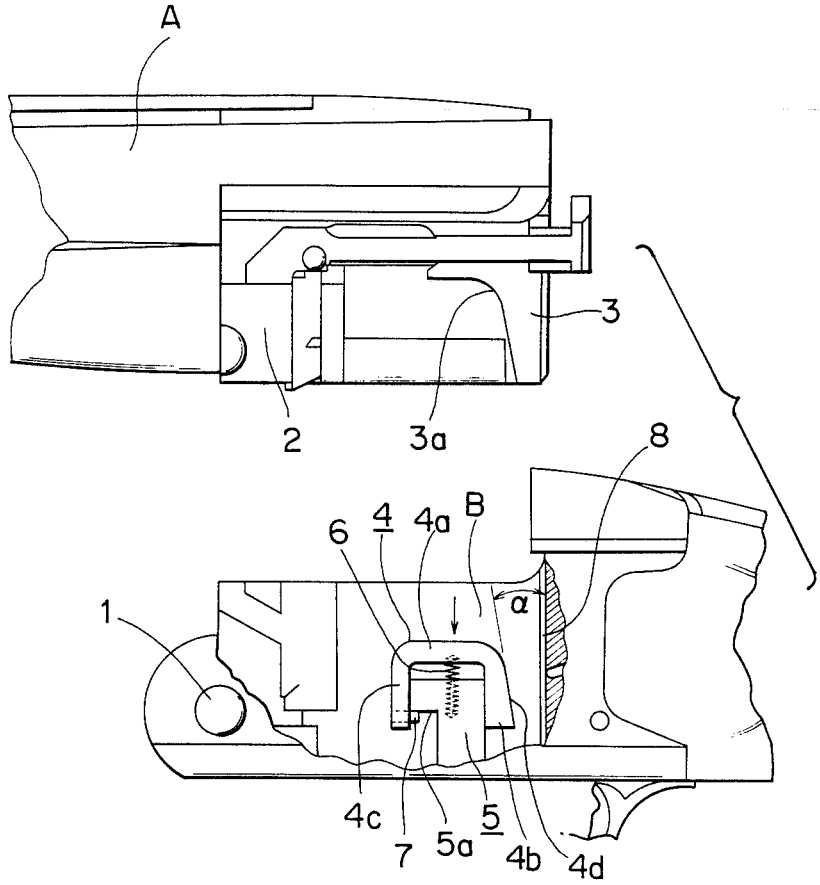
FIG. 3 is a side view of a barrel locking mechanism of the present invention in its exploded state with parts partly broken away.
Figure 4:
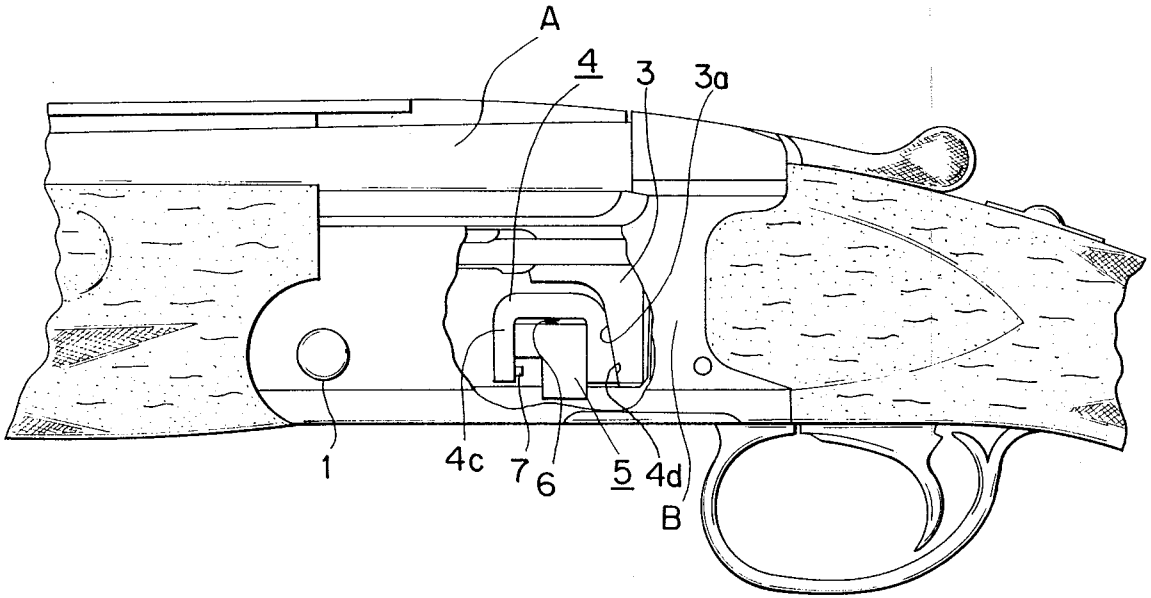
FIG. 4 is a side view in its locked state with parts partly broken away.

With the above construction, when the gun is break-opened, the movable receiver 4 is raised upwards by means of the coil spring 6, as shown in FIG. 3. In this state, if the gun is gradually shut, the declining contact-surface 3*a* of the lug 3 of the barrel section A contacts the movable receiver 4 approximately midway and then compresses the movable receiver 4 downwards against the coil spring 6. When the gun is completely shut or locked, then the declining contact-surfaces 3*a* and 4*d* are intimately contacted with each other and the coil spring 6, in its compressed state, serves to maintain intimate contact therebetween.

Figure 5:
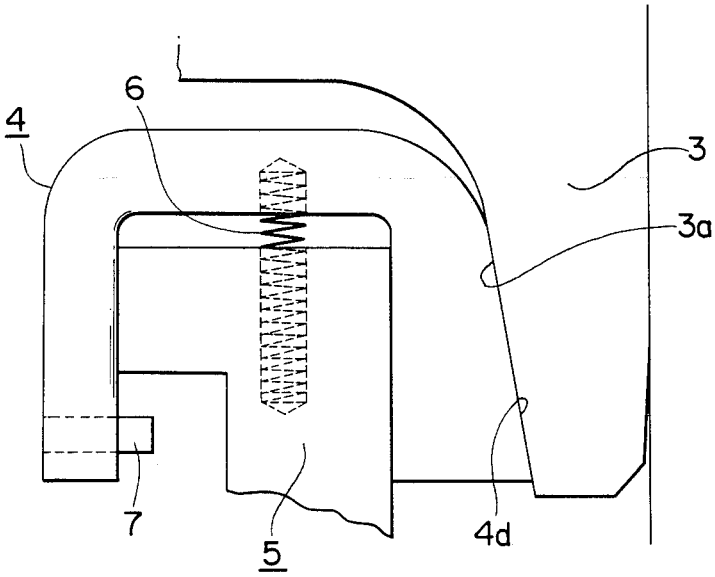
FIG. 5 is a detail view showing a movable receiver in its lowest position.
Figure 6:
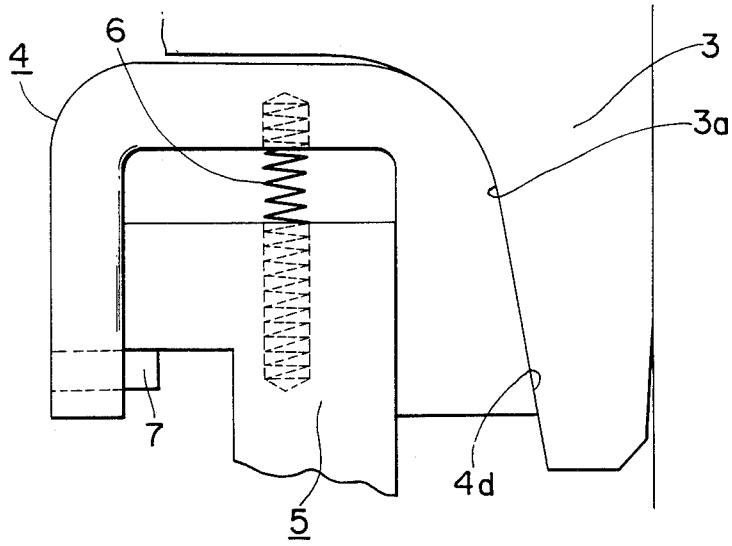
FIG. 6 is a detail view showing the movable receiver in its highest position.

According to the present invention, even if the corresponding contact surfaces should be worn, the movable receiver is moved for effecting self-compensation by means of the biasing force of the spring. Therefore, even if lack of uniformity should be created between the corresponding surfaces due to poor workmanship, intimate contact can still be maintained without any special adjustment. As long as the movable receiver is kept between the range of the lowest position, as shown in FIG. 5, and the highest position, as shown in FIG. 6, the declining contact-surfaces of the movable receiver and the lug are always kept well contacted and thereby ensuring perfect performance. Therefore, the manufacturing accuracy of the corresponding parts is required only to such degree as to maintain the above range. Thus, according to the present invention, manufacturing difficulties are resolved, elaborate work for filing the surfaces is eliminated and the barrel of a gun can be interchangeable among several guns.

What is claimed is:

1. A barrel locking mechanism for a break-open gun having a barrel portion pivotally connected to a mechanical portion, including a breech face, by a pin assembly, said barrel locking mechanism comprising:

(a) a lug secured to the barrel portion of the gun, said lug including a first contact surface;

(b) stationary receiver means secured to the mechanical portion of the gun;

(c) movable receiver means slidably mounted upon said stationary receiver means and including a second contact surface adapted for engaging said first contact surface;

(d) resilient means operably associated with said stationary receiver means and said movable receiver means for biasing said movable receiver means so that said contact surfaces engage when the barrel portion is pivoted into a locked position with the mechanical portion; and, (e) said contact surfaces being angularly disposed relative to said breech face for assuring contact therebetween.

2. The mechanism as defined in claim 1, wherein:

(a) said movable receiver means including a generally U-shaped member having a pair of spaced legs disposed adjacent opposite sides of said stationary receiver means.

3. The mechanism as defined in claim 1, wherein:

(a) said movable receiver means including an inverted generally U-shaped member positioned on said stationary receiver means.

4. The mechanism as defined in claim 1, wherein:

(a) said stationary receiver means including a shoulder portion extending therefrom; and, (b) means associated with said movable receiver means engageable with said shoulder portion for preventing excess movement of said movable receiver means.

5. The mechanism as defined in claim 1, wherein:

(a) said contacting surfaces subtending substantially equal angles.

6. The mechanism as defined in claim 5, wherein:

(a) the angle subtended by each of said contact surfaces being less than the friction angle of the material comprising said lug and said moveable receiver means.

7. The mechanism as defined in claim 5, wherein:

(a) each of said contacting surfaces subtending an angle of generally 10°.

8. The mechanism as defined in claim 1, wherein:

(a) said resilient means including a spring.

9. A barrel locking mechanism for a break-open gun including a forward barrel portion and a rearward mechanical portion including a breech face, said barrel portion being hingedly connected to said mechanical portion by a pin assembly and said mechanical portion including means for receiving a portion of said barrel portion rearwardly of said pin assembly when the barrel portion is locked to the mechanical portion, said barrel locking mechanism comprising:

(a) a lug secured to the barrel portion rearwardly of the pin assembly and having a first contact surface generally directed toward the pin assembly;

(b) a stationary receiver mounted to said mechanical portion rearwardly of the pin assembly;

(c) a movable receiver positioned between said lug and said stationary receiver, slidably mounted upon said stationary receiver, and having a second contact surface directed generally away from said pin assembly;

(d) resilient means disposed between said receivers for biasing said movable receiver so that said contact surfaces engage when the barrel portion is locked to the mechanical portion; and, (e) said contact surfaces being angularly disposed relative to said breech face and subtending substantially equal angles.

10. The mechanism as defined in claim 9, wherein:

(a) said movable receiver including an inverted generally U-shaped member having a pair of spaced legs disposed adjacent opposite sides of said stationary receiver means.

11. The mechanism as defined in claim 9, wherein:

(a) said stationary receiver including a shoulder portion; and, (b) said movable receiver including a stop pin engageable with said shoulder portion for controlling movement of said movable receiver.

12. The mechanism as defined in claim 9, wherein:

(a) said resilient means including a coil spring.

13. The mechanism as defined in claim 9, wherein:

(a) said angles being substantially 10°.

14. A barrel locking mechanism, comprising:

(a) a break-open gun including a barrel portion pivotally connected by a pin assembly to a mechanical portion having a breech face;

(b) a lug secured to said barrel portion and including a first angularly disposed contact surface;

(c) a stationary receiver secured to said mechanical portion rearwardly of said pin assembly and including a second angularly disposed contact surface for engaging said first contact surface when said barrel portion is lockingly engaged with said mechanical portion;

(d) a generally U-shaped inverted movable receiver slidably received by said stationary receiver and adapted for movement thereon;

(e) resilient means disposed between and operably associated with said receivers for biasing said movable receiver so that said second contact surface maintains engagement with said first contact surface when said barrel portion is lockingly engaged with said mechanical portion; and, (f) said contact surfaces being angularly disposed relative to said breech face and subtending substantially equal angles.

15. The mechanism as defined in claim 14, wherein:

(a) said stationary receiver including a shoulder portion; and, (b) a stop pin extending from said movable receiver for engaging said shoulder portion and thereby controlling movement of said movable receiver.

16. The mechanism as defined in claim 14, wherein:

(a) said contact surfaces subtending an angle less than the friction angle of the material comprising said lug and said movable receiver.

17. The mechanism as defined in claim 14, wherein:

(a) said stationary receiver being disposed forwardly of said first contact surface when said barrel portion is lockingly engaged with said mechanical portion.

* * * * *